US006812778B1

(12) United States Patent
Yeo et al.

(10) Patent No.: US 6,812,778 B1
(45) Date of Patent: Nov. 2, 2004

(54) COMPENSATING CAPACITIVE MULTIPLIER

(75) Inventors: Kok Soon Yeo, Singapore (SG); Ai min Xu, Singapore (SG); Hong Meng Joel Tang, Singapore (SG)

(73) Assignee: 02Micro International Limited, British West Indies (KY)

( * ) Notice: Subject to any disclaimer, the term of this patent is extended or adjusted under 35 U.S.C. 154(b) by 3 days.

(21) Appl. No.: 10/350,424

(22) Filed: Jan. 24, 2003

(51) Int. Cl.[7] ..... G05F 1/10
(52) U.S. Cl. ..... 327/541; 327/382; 327/562
(58) Field of Search ..... 327/382, 530, 327/534, 535, 537, 538, 540, 541, 543, 560, 561, 562, 563

(56) References Cited

U.S. PATENT DOCUMENTS 5,889,393 A 3/1999 Wrathall ..... 323/282
6,084,475 A 7/2000 Rincon-Mora ..... 330/255
6,262,633 B1 * 7/2001 Close ..... 330/267
6,304,131 B1 10/2001 Huggins et al. ..... 327/538
6,316,987 B1 * 11/2001 Dally et al. ..... 327/538
6,373,233 B2 4/2002 Bakker et al. ..... 323/282
6,683,489 B1 * 1/2004 Eker ..... 327/538

OTHER PUBLICATIONS

Gabriel Alfonso Rincon–Mora, Texas Instruments Incorporated, Dallas, TX 75243, "Active Capacitor Multiplier in Miller–Compensated Circuits" pp. 1–16.

* cited by examiner

*Primary Examiner*—Jeffrey Zweizig
(74) *Attorney, Agent, or Firm*—Grossman, Tucker, Perreault & Pfleger, PLLC

(57) ABSTRACT

A compensating circuit for providing a compensating control signal to a regulating circuit is provided. The compensating circuit includes a multiplying circuit and a miller capacitor. The multiplying circuit may provide a predetermined multiplication factor to a miller current level based on a resistor ratio. The multiplying circuit may also provide a voltage gain stage before the miller capacitor. Both multiplying circuits enable the size of the miller capacitor to be reduced resulting in valuable printed circuit board space savings.

43 Claims, 7 Drawing Sheets

COMPENSATING CAPACITIVE MULTIPLIER

FIELD OF THE INVENTION

The present invention relates to frequency compensation of electronic circuits, and in particular to circuits with a compensation capacitor such as a Miller Effect capacitor.

BACKGROUND OF THE INVENTION

A variety of electronic circuits require frequency compensation to enhance stability of the circuit. One such circuit is a low dropout voltage regulator (LDO). An LDO may be used in a variety of electronic devices such as cell phones, lap top computers, personal digital assistants, and the like. The LDO should be small in size, use less or cheaper external components, while exhibiting good regulation and fast transient response.

The compensation technique for the LDO can affect such factors. One compensation approach utilizes external compensation. This eliminates the need for internal compensation but also poses some problems. First, the external dominant pole shifts to a higher frequency when the load current increases. Second, the second non-dominant pole has to be shifted to a much higher frequency. A buffer with low output impedance could be used to achieve this, at the expense of a larger bias current. Further compromise has to be made using a capacitor having an appropriate equivalent series resistance (ESR) to provide a sufficient phase margin. These potential solutions, however, only work suitably if the LDO does not source a large load current.

Another compensation approach utilizes internal compensation. Such an internal compensation technique known in the art takes advantage of the Miller Effect by adding a Miller compensating capacitor to accomplish "pole splitting." This approach generates a first dominant pole and a second non-dominant pole and has an associated unity gain frequency. However, a certain relationship must exist between the unity gain frequency and the second non dominant pole in order to maintain a minimum phase margin for the LDO.

For example, if the LDO requires a minimum phase margin of 60 degrees, the unity gain frequency would have to be at least a factor of two lower than the second non-dominant pole. This relationship between the unity gain frequency and the second non-dominant pole depends, in part, on the relationship between the Miller capacitance level and the load capacitance level. As the load capacitance level gets higher, so too must the Miller capacitance level. However, a larger Miller capacitor occupies more space in an environment where there is a premium on such space.

Accordingly, there is a need in the art for a compensating circuit for compensating circuits such as an LDO, where the compensating circuit includes a multiplying circuit for reducing the size of the Miller capacitor.

BRIEF SUMMARY OF THE INVENTION

A compensation circuit for providing a compensating capacitive current to a regulating circuit consistent with the invention includes: a capacitor; and a multiplying circuit configured to accept an input capacitive current provided from the capacitor and multiply the input capacitive current by a predetermined multiplication factor to provide the compensating capacitive current, wherein the predetermined multiplication factor is based on a resistor ratio.

An LDO consistent with the invention includes: a regulating circuit having an input terminal, an output terminal, and a control terminal, the regulating circuit configured to receive an input signal at the input terminal and provide an output signal at the output terminal; a control circuit coupled to the control terminal of the regulating circuit, and configured to control the regulating circuit; and a compensating circuit for providing a compensating capacitive current to the regulating circuit, the compensating circuit including a capacitor and a multiplying circuit configured to accept an input capacitive current provided from the capacitor and multiply the input capacitive current by a predetermined multiplication factor to provide the compensating capacitive current, wherein the predetermined multiplication factor is based on a resistor ratio.

Another LDO consistent with the invention includes: a regulating circuit having an input terminal, an output terminal, and a control terminal, the regulating circuit configured to receive an input signal at the input terminal and provide an output signal at the output terminal; and a control circuit coupled to the control terminal of the regulating circuit, and configured to control and compensate the regulating circuit, the control circuit including a multiplying circuit configured to accept an input capacitive current from a capacitor and multiply the input capacitive current by a multiplication factor, wherein the multiplication factor is based on a resistor ratio.

An electronic device consistent with the invention includes: a power source configured to provide an unregulated power signal; and at least one LDO coupled to the power source for providing a regulated voltage signal to an associated load of the device, wherein the LDO includes: a regulating circuit having an input terminal, an output terminal, and a control terminal, the regulating circuit configured to receive the unregulated power signal from the power source at the input terminal and provide the regulated voltage signal at the output terminal; and a control circuit coupled to the control terminal of the regulating circuit, and configured to control and compensate the regulating circuit, the control circuit including a multiplying circuit configured to accept an input capacitive current from a capacitor and multiply the input capacitive current by a multiplication factor, wherein the multiplication factor is based on a resistor ratio.

A method of compensating a regulating circuit wherein the regulating circuit has an output terminal and a control terminal, the method consistent with the invention includes the steps of: receiving an input capacitive current through a capacitor coupled to the control terminal of the regulating circuit; and multiplying the input capacitive current by a multiplication factor to provide the compensating capacitive current to the control terminal of the regulating circuit, wherein the multiplication factor is based on a resistor ratio.

According to another aspect of the invention, there is provided a compensating circuit for providing a compensating voltage gain to a regulating circuit. The compensation circuit includes a voltage gain stage circuit configured to accept a first voltage signal representative of an output voltage level of the regulating circuit and multiply the first voltage signal by a predetermined multiplication factor to provide a second voltage signal, and a capacitor configured to accept the second voltage signal and provide the compensating voltage gain to the regulating circuit.

According to a further aspect of the invention, there is provided a LDO including a regulating circuit having an input terminal, an output terminal, and a control terminal.

The regulating circuit is configured to receive an input voltage signal at the input terminal and provide an output voltage signal at the output terminal. The LDO also includes a control circuit coupled to the control terminal of the regulating circuit, and configured to control the regulating circuit, and a compensation circuit coupled to the control terminal of said regulating circuit and configured to provide a compensating voltage gain to the regulating circuit. The compensating circuit includes a voltage gain stage circuit configured to accept a first voltage signal representative of the output voltage signal of the regulating circuit and multiply the first voltage signal by a predetermined multiplication factor to provide a second voltage signal; and a capacitor configured to accept the second voltage signal and provide the compensating voltage gain to the regulating circuit.

According to yet a further aspect of the invention there is provided an electronic device having a power source configured to provide an unregulated power signal; and at least one LDO coupled to the power source for providing a regulated voltage signal to an associated load of the device, wherein the at least one LDO includes: a regulating circuit having an input terminal, an output terminal, and a control terminal, the regulating circuit configured to receive an input voltage signal at the input terminal and provide an output voltage signal at the output terminal; a control circuit coupled to the control terminal of the regulating circuit, and configured to control the regulating circuit; and a compensation circuit coupled to the control terminal of the regulating circuit and configured to provide a compensating voltage gain to the regulating circuit, the compensation circuit including a voltage gain stage circuit configured to accept a first voltage signal representative of the output voltage signal of the regulating circuit and multiply the first voltage signal by a predetermined multiplication factor to provide a second voltage signal, and a capacitor configured to accept the second voltage signal and provide the compensating voltage gain to the regulating circuit.

Finally, there is provided a method of compensating a regulating circuit wherein the regulating circuit has an output terminal and a control terminal, the method including the steps of: receiving a first voltage signal representative of an output voltage at the output terminal of the regulating circuit; multiplying the first voltage signal by a predetermined multiplication factor to provide a second voltage signal; and providing the second voltage signal to a capacitor, the capacitor in turn provides a compensating voltage gain to the control terminal of the regulating circuit.

BRIEF DESCRIPTION OF THE DRAWINGS

Advantages of the present invention will be apparent from the following detailed description of exemplary embodiments thereof, which description should be considered in conjunction with the accompanying drawings, in which.

DETAILED DESCRIPTION

Figure 1:
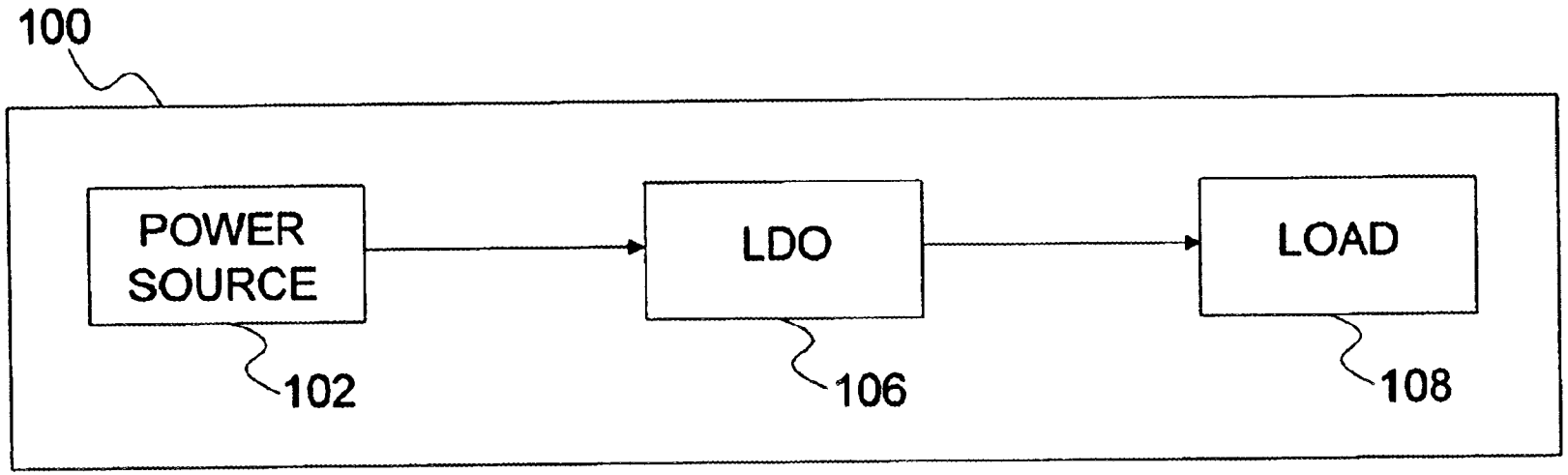
FIG. 1 is a block diagram of electronic device having an LDO consistent with the present invention.

Turning to FIG. 1, a simplified block diagram of an electronic device 100 having a power source 102, an LDO 106 consistent with the invention, and a load 108 is illustrated. The electronic device 100 may be a variety of devices such as a portable electronic device including a PDA, lap top computer, cell phone, etc. For such portable electronic devices the power source 102 is typically a battery, e.g., lithium battery, for providing unregulated DC voltage to an LDO 106. A DC/DC converter may also be utilized between the power source and the LDO to further isolate the raw input DC voltage from the load. Any one device 100 may also have a plurality of LDOs to clean up the output voltage of the power source and provide power supply isolation to various loads or applications that share the same raw DC power supply.

Figure 2:
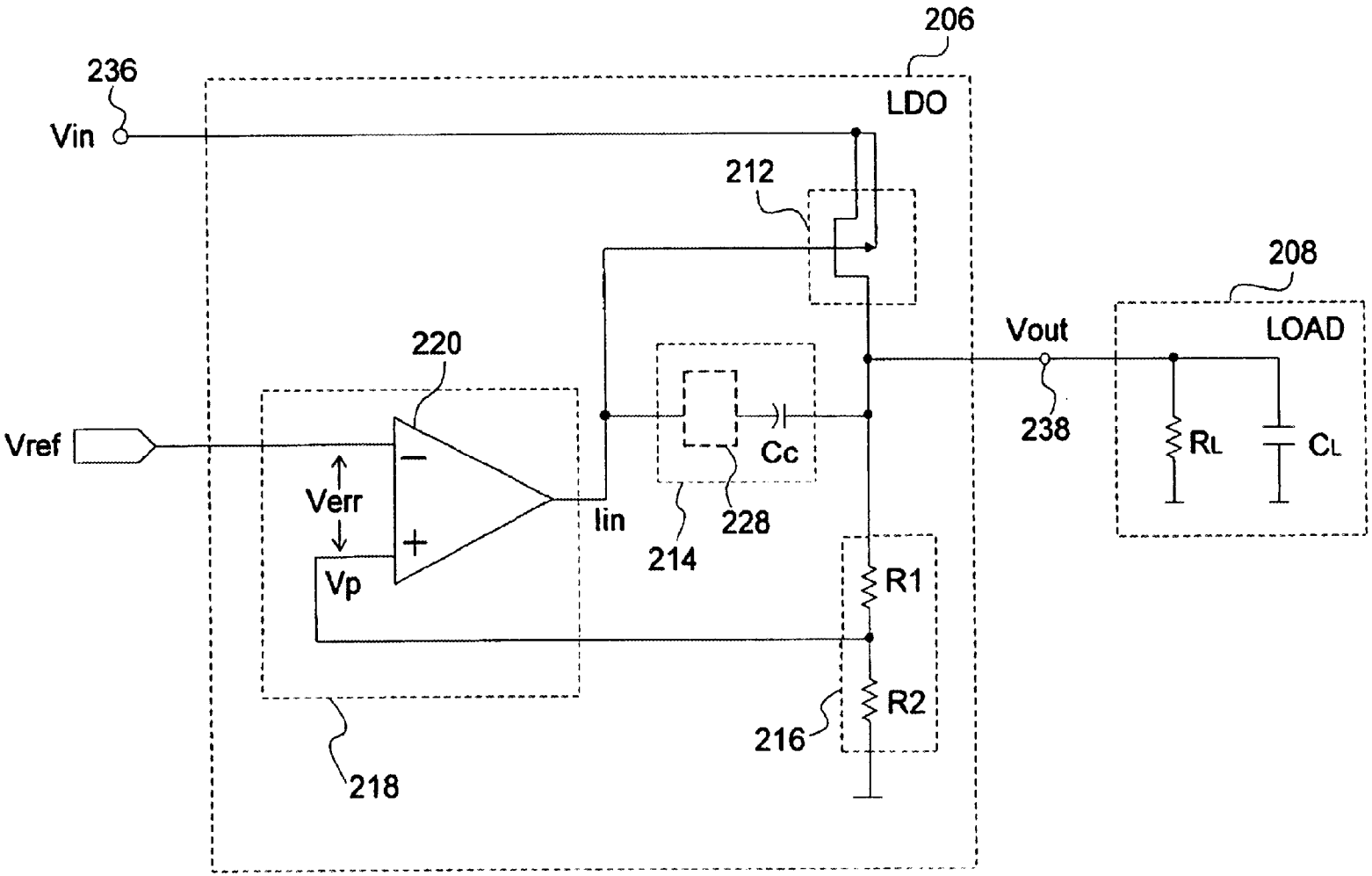
FIG. 2 is a block diagram of the LDO of FIG. 1.

Turning to FIG. 2, a more detailed block diagram of an LDO 206 consistent with the invention that may be utilized in the electronic device 100 of FIG. 1 is illustrated. The LDO 206 receives an input voltage at terminal 236 and provides an output voltage at terminal 238 to the load 208, which may includes a resistive load $R_L$ and capacitive load $C_L$. The LDO 206 generally includes a regulating circuit 212, a feedback network 216, a control circuit 218, and a compensating circuit 214 consistent with the invention. An exemplary regulating circuit 212 may include a p-type metal oxide semiconductor field effect transistor (MOSFET) as illustrated. Other transistors may also be utilized including bipolar junction transistors.

The feedback network 216 scales down the output voltage $V_{OUT}$ of the LDO 206 to a lower voltage level $V_P$ representative of the output voltage. Such a feedback network 216 may include a pair of resistors R1 and R2 to provide this scale down function where where $V_P=V_{OUT}$ (R2/R1+R2) in this instance.

The control circuit 218 may include the operational amplifier 220. The operational amplifier may be an operational transconductance amplifier (OTA). The amplifier 220 compares the reference voltage Vref from a reference voltage source with the scaled down voltage $V_P$ and provides an appropriate control signal to the regulating circuit 212 based on the difference between such voltage signals or the voltage error signal Verr. The regulating circuit 212 is responsive to this control signal to make any necessary adjustments to drive the voltage error signal Verr as close to zero as possible by modifying the output voltage level $V_{OUT}$.

The stability of the LDO 206 is improved by the compensating circuit 214 which includes the miller compensating capacitor $C_C$ and multiplying circuit 228 as further detailed herein. The multiplying circuit 228 may have discrete components separate from the operational amplifier 220 or, in other embodiments (see FIG. 5), may include components that are advantageously already part of the operational amplifier 220. The multiplying circuit 228 may include a capacitive current multiplication circuit or a voltage gain stage circuit which are both further detailed herein.

In both situations, the multiplying circuit 228 shifts the dominant pole K times lower while the non-dominant pole is shifted K times higher enabling the size of the miller capacitor to be reduced by an equivalent amount based on this factor K.

Figure 3:
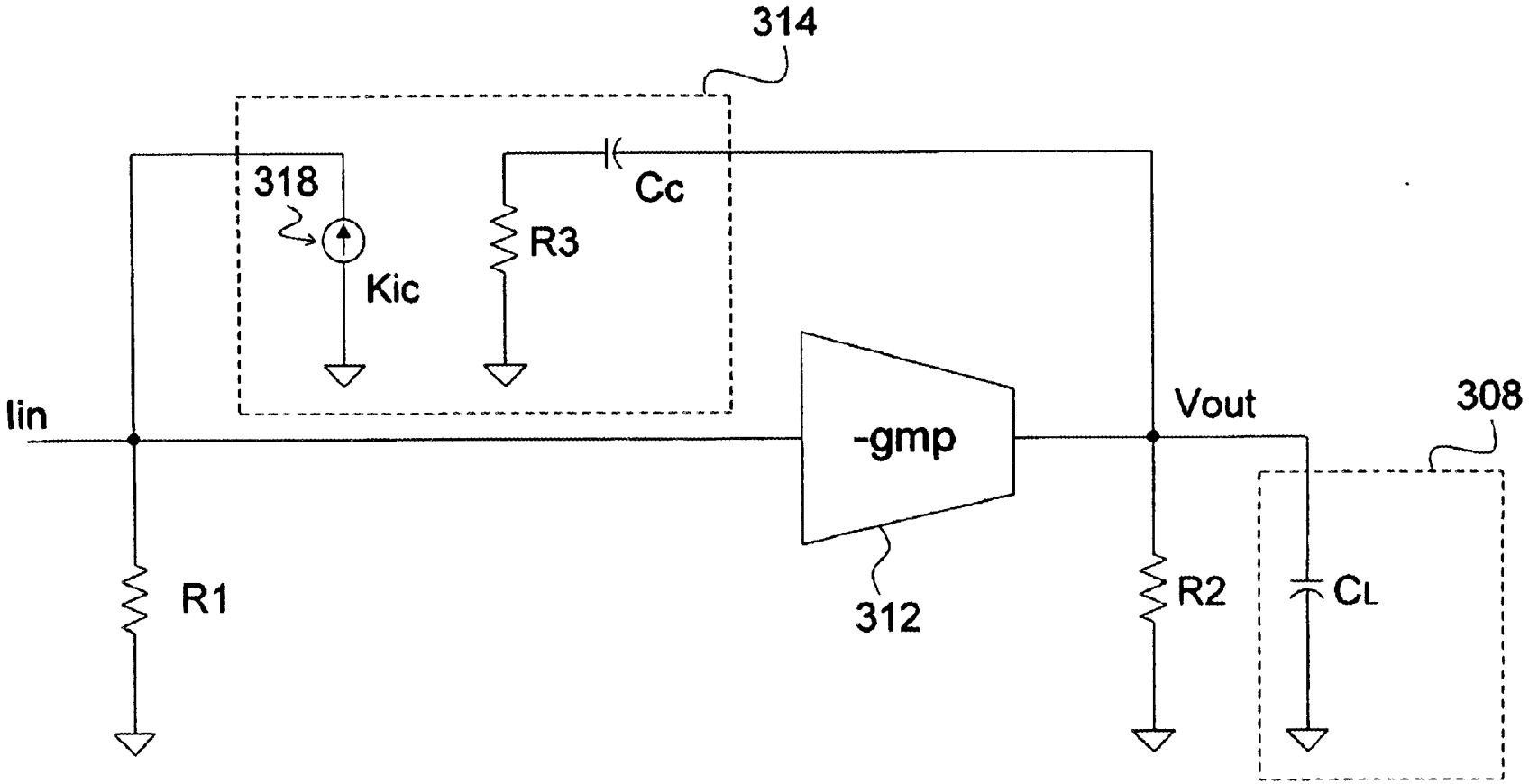
FIG. 3 is a simplified block diagram of the LDO of FIG. 2 illustrating a compensating circuit for providing a compensating capacitive current to the regulating circuit of the LDO.

Turning to FIG. 3, a block diagram of the LDO of FIG. 2 is illustrated where the multiplying circuit 228 functions as a capacitive current multiplication circuit for providing a compensating capacitive current to the regulating circuit. The regulating circuit 212 is represented as a transconductance amplifier $g_{mp}$ 312. The input current Iin from the control circuit 218 is input to the transconductance amplifier $g_{mp}$ 312. The compensating circuit 314 includes the miller compensating capacitor $C_C$ and resistor R3 connected in series therewith. In parallel with such RC network is an amplified current source 318. The amplified current source 318 provides the multiplication factor K times the miller capacitive current $i_c$.

As such, the dominant pole $\omega_1$, the non-dominant pole $\omega_2$, and the unity gain frequency $\omega_z$ for the simplified block diagram of FIG. 3 are given by equations 1–3.

$$\omega_1=1/Kgm_pR_1R_2C_C \quad (1)$$

$$\omega_2=Kgm_pR_1/R_3C_L \quad (2)$$

$$\omega_z=1/R_3C_C \quad (3)$$

Compared to a traditional miller compensating capacitor technique, the dominant pole $\omega_1$ is amplified by a factor of 1/K times and the second non-dominant pole $\omega_2$ is amplified by a factor equal to $K*R_1/R_3$. Since the second non-dominant pole is shifted higher by this $K*R_1/R_3$ factor and the dominant pole is also shifted lower by the factor 1/K, an LDO utilizing such a compensation circuit advantageously has a wider bandwidth than traditional miller compensated LDOs. Shifting the second non-dominant pole by this factor eliminates any requirement for an external compensating capacitor with a well defined equivalent series resistance (ESR) to increase the phase margin. Instead, ceramic capacitors may be utilized providing better efficiency.

A left hand plane (LHP) zero also results compared to traditional Miller compensation. This LHP zero can be optimized to improve the phase margin of the feedback loop. For example, the LHP zero can be designed to cancel an applicable pole which consequently improves the phase margin. In addition, the size of the compensating capacitor Cc can also be advantageously reduced saving much needed space on a relevant integrated circuit.

Figure 4B:
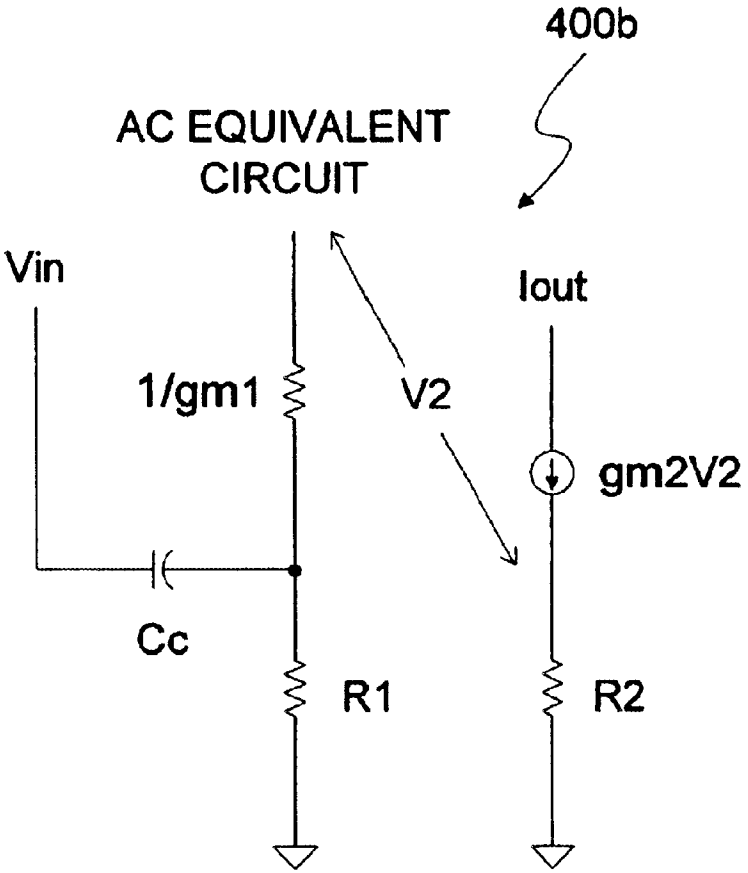
FIG. 4B is an AC equivalent circuit for the multiplying circuit of FIG. 4A.
Figure 4A:
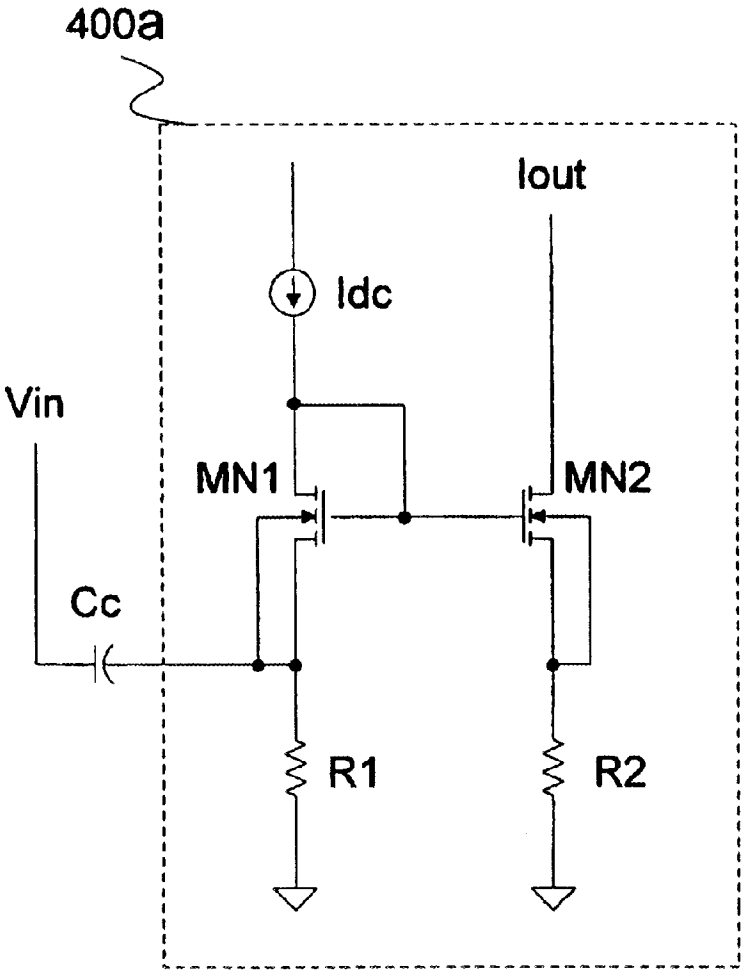
FIG. 4A is a circuit diagram of an exemplary multiplying circuit for multiplying the capacitive current through the miller capacitor based on a resistor ratio.

Turning to FIGS. 4A and 4B a circuit diagram of an exemplary multiplying circuit 400*a* for multiplying the capacitive current based on a resistor ratio, and its AC equivalent circuit 400*b* is illustrated. In general, the exemplary multiplying circuit 400*a* is a current mirror with resistors R1 and R2 coupled to the respective drains of transistors MN1 and MN2. The transistors MN1 and MN2 are n-type MOSFETS having their control terminals or gates terminals coupled together. Those skilled in the art will recognize that any other type and variety of transistors may also be utilized. The input voltage Vin is converted to a current Iin through the RC network and further multiplied by the multiplication factor K at its output as described below.

The transfer function of the multiplying circuit 400*a* is given by equation 4.

$$Iout/Iin=gm_2R1/(1+gm_2R2) \quad (4)$$

If $gm_2R2>>1$, then Iout/In=R1/R2=K, where K is the multiplication factor. Therefore, by proper selection of R2 and the biasing of transistor MN2, the multiplication factor K can advantageously be solely based on the ratio of the resistors R1 and R2.

Figure 5:
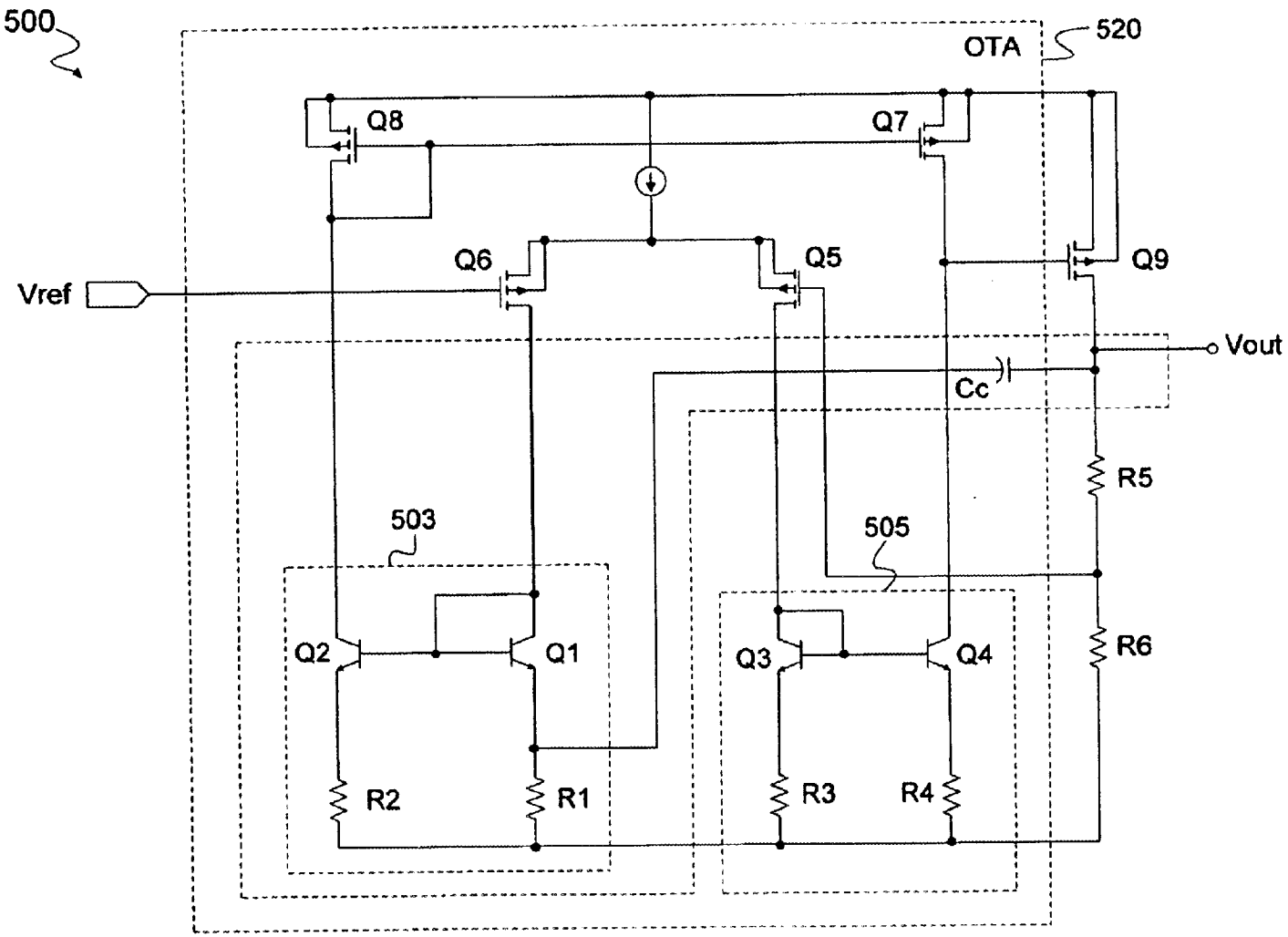
FIG. 5 is an exemplary circuit diagram of an LDO having a multiplying circuit for multiplying the capacitive current through the miller capacitor.

Turning to FIG. 5, an exemplary circuit diagram of an LDO 500 implementing a capacitive current multiplier with a resistor ratio is illustrated. In this circuit embodiment 500, the multiplication of the capacitive current through a resistor ratio is advantageously accomplished by a multiplying circuit 503 which utilizes existing components of the first stage operational transconductance amplifier 520. The compensating capacitor $C_C$ is coupled between the output terminal of output transistor Q9 functioning as a regulating circuit of the LDO and the emitter of transistor Q1.

Multiplying circuit 503 is generally a current mirror generally including a pair of transistors Q1 and Q2 and resistors R1 and R2. Transistors Q1 and Q2 are both NPN type transistors that have their respective base electrodes coupled together. A first resistor R1 is coupled to the emitter of transistor Q1 and another resistor R2 is coupled to the emitter of transistor Q2 such that R1 and R2 are connected in parallel. The collector of transistor Q1 is coupled to the base of Q2 and also to the drain of transistor Q6. The collector of transistor Q2 is coupled to the drain of transistor Q8.

In operation, the capacitive current through the miller capacitor $C_C$ is multiplied by the multiplying circuit 503. With a suitable sufficient gain of transistor Q2 such that $gm_2R_2>>1$, the multiplication factor K provided by the multiplying circuit 503 is equal to R1/R2. This multiplied current is then mirrored through current mirror including Q8 and Q7 to provide compensation to the control or gate terminal of the output transistor Q9. The OTA 520 accepts the reference voltage Vref at transistor Q6 and a scaled down version of the output voltage Vout at transistor Q5 and provides a control signal to the control terminal of output transistor Q9 having the earlier detailed compensation. Biasing circuit 505 provides proper DC biasing.

Figure 6:
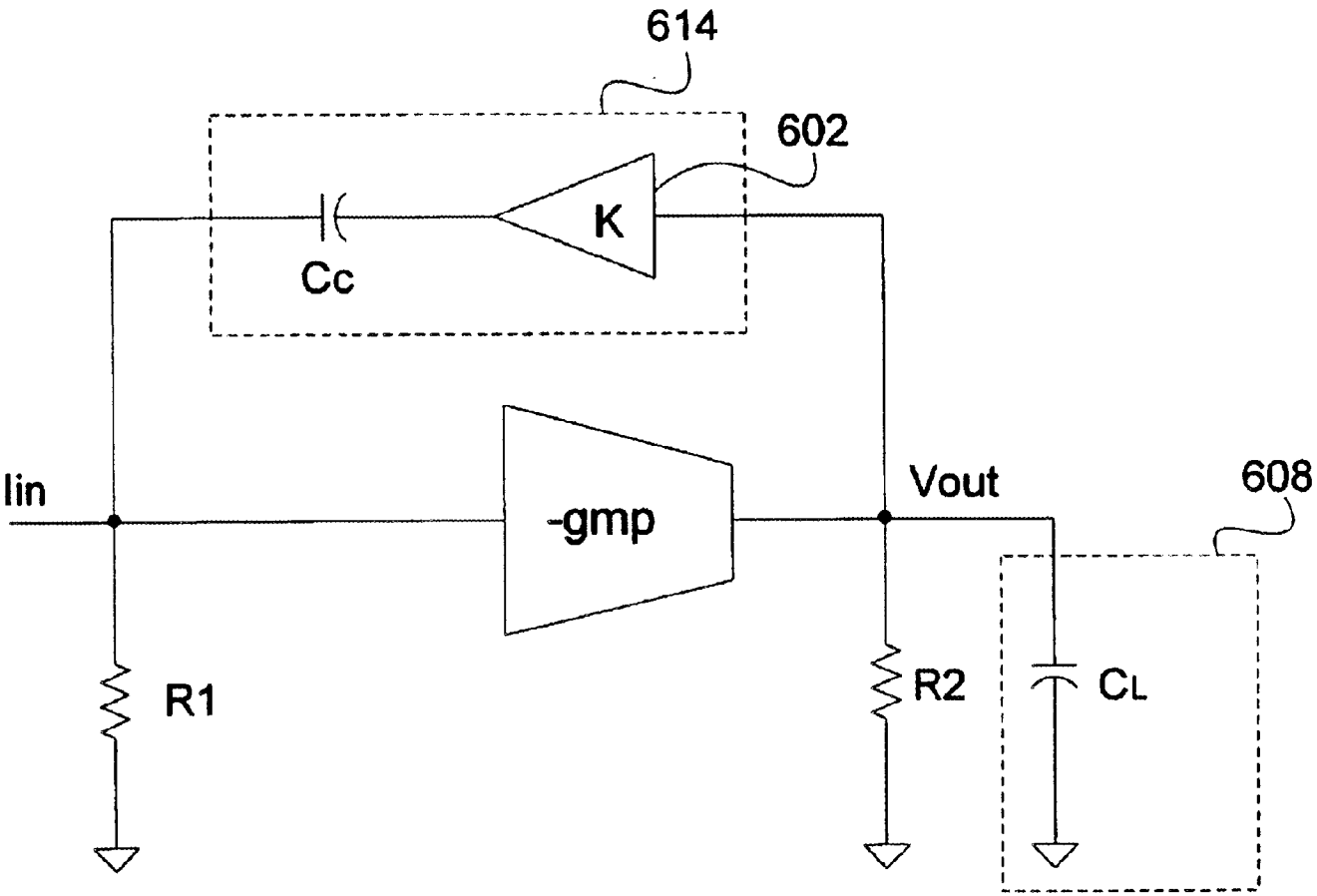
FIG. 6 is a simplified block diagram of an LDO illustrating a compensating circuit for providing a compensating voltage gain signal to the regulating circuit of the LDO.

Turning to FIG. 6, a simplified block diagram of an LDO illustrating another compensating circuit 614 having a voltage gain stage circuit 602 contributing gain K is illustrated. The voltage gain stage circuit 602 alters the dominant pole and non-dominant pole as detailed in equations 5 and 6.

$$\omega_1=1/Kgm_pR_1R_2C_C \quad (5)$$

$$\omega_2=Kgm_pC_L \quad (6)$$

As such, the dominant pole ω1 is shifted lower by the factor 1/K and the non-dominant pole ω2 is shifted higher by the factor K in the frequency domain. As such, an LDO utilizing such a compensating circuit 614 advantageously has a wider bandwidth than traditional miller compensated LDOs. Shifting the second non-dominant pole by this factor eliminates any requirement for an external compensating capacitor with a well defined ESR to increase the phase margin. Instead, ceramic capacitors may be utilized providing better efficiency. In addition, the right hand plane zero resulting from typical miller compensation is also eliminated.

Figure 7:
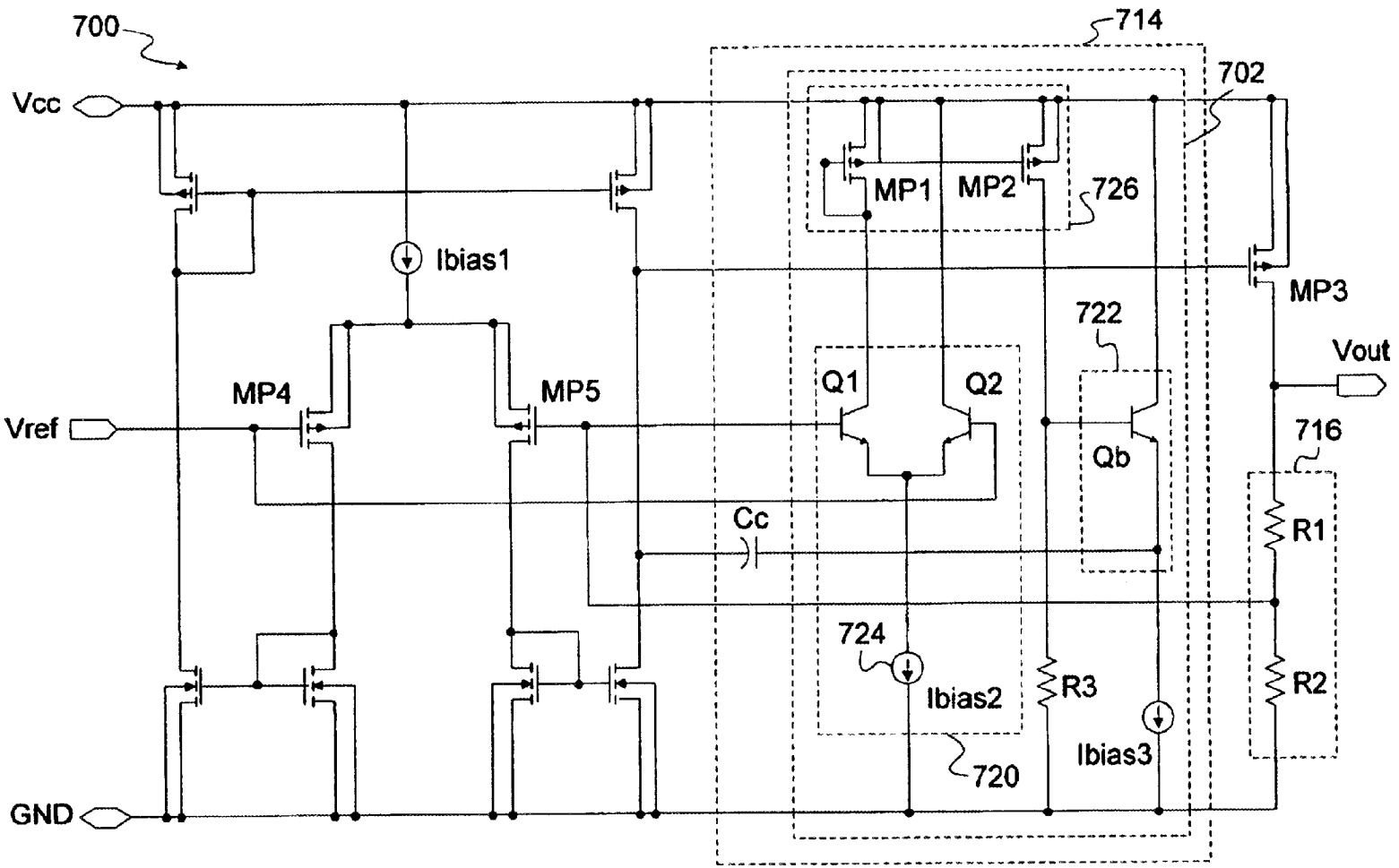
FIG. 7 is an exemplary circuit diagram for the LDO of FIG. 6 having a voltage gain stage circuit consistent with the invention.

Turning to FIG. 7, an exemplary circuit diagram 700 for implementing the compensating circuit portion of the LDO of FIG. 6 is illustrated. The LDO 700 includes a compensating circuit 714 having an exemplary voltage gain stage circuit 702 and miller compensating capacitor $C_C$. In general, the voltage gain stage circuit 702 is configured to accept a first voltage signal at the control electrode of transistor Q1 representative of the output voltage level Vout and multiply such signal by a predetermined multiplication factor to provide a second voltage signal to the miller capacitor Cc.

The voltage gain stage circuit 702 generally includes a differential pair 720, a current mirror 726, a follower circuit 722, and resistor R3. The voltage gain stage circuit 702 utilizes the differential pair 720 to increase its input dynamic range. The differential pair 720 may be a bipolar differential pair including bipolar NPN transistors Q1 and Q2 having there respective emitters shorted together. The transistor pair Q1, Q2 is biased by a current source 724.

Transistor Q1 has its control or base electrode coupled to the feed back network 716 in order to provide a multiplication factor K to the miller compensating capacitor $C_C$. Transistor Q2 has its control or base electrode coupled to the input reference voltage Vref of the LDO 700 for DC biasing. The multiplication factor K should be much lower than the system open loop gain to prevent the output from saturating.

The follower circuit 722 may be an emitter follower circuit as illustrated including transistor Qb which effectively reduces the output resistance of the output stage. Transistor Qb provides an output voltage at its emitter electrode to the miller capacitor $C_C$ which essentially follows an input voltage to its base electrode as provided by the current mirror 726. The output voltage of the follower circuit 722 thus provides a multiplication factor K, or voltage gain factor in this instance, to the miller capacitor $C_C$ which is, in turn, used to provide compensation to the control or gate terminal of the output transistor MP3.

As such, the LDO 700 accepts the reference voltage Vref at transistor MP4 and a scaled down version of the output voltage Vout at transistor MP5 and provides a compensated control signal to the control terminal of output transistor MP3 having the earlier detailed voltage gain compensation from the voltage gain stage circuit 702. The multiplication K factor provided by the voltage gain stage circuit is a function of $gm_{Q1}$, the ratio of transistors MP1 and MP2, and R3. If the ratio of transistors MP1 and MP2 is $\alpha$, then the gain factor K is $\alpha gm_{Q1}R3$.

The embodiments that have been described herein, however, are but some of the several which utilize this invention and are set forth here by way of illustration but not of limitation. It is obvious that many other embodiments, which will be readily apparent to those skilled in the art, may be made without departing materially from the spirit and scope of the invention as defined in the appended claims.

What is claimed is:

1. A compensating circuit for providing a compensating capacitive current to a regulating circuit, said compensation circuit comprising:

a capacitor; and a multiplying circuit configured to accept an input capacitive current provided from said capacitor and multiply said input capacitive current by a predetermined multiplication factor to provide said compensating capacitive current, wherein said predetermined multiplication factor is based on a resistor ratio.

2. The compensating circuit of claim 1, wherein said multiplying circuit comprises:

a first transistor having a first terminal and a control terminal;

a second transistor having a first terminal, a second terminal, and a control terminal, wherein said control terminal of said first transistor is coupled to said control terminal of said second transistor;

a first resistor coupled to said first terminal of said first transistor; and a second resistor coupled to said first terminal of said second transistor, wherein said resistor ratio is equal to a ratio between said first resistor and said second resistor, and wherein said compensating capacitive current is provided at said second terminal of said second transistor.

3. The compensating circuit of claim 2, wherein said predetermined multiplication factor is equal to a first resistive value of said first resistor divided by a second resistive value of said second resistor.

4. The compensating circuit of claim 2, wherein said first transistor and said second transistor are bipolar junction transistors, and said first terminal of said second transistor is an emitter terminal, said second terminal of said second transistor is a collector terminal, and said control electrode of said second transistor is a base terminal.

5. The compensating circuit of claim 2, wherein said first transistor and said second transistor are MOSFET transistors.

6. A low dropout voltage regulator (LDO) comprising:

a regulating circuit having an input terminal, an output terminal, and a control terminal, said regulating circuit configured to receive an input signal at said input terminal and provide an output signal at said output terminal;

a control circuit coupled to said control terminal of said regulating circuit, and configured to control said regulating circuit; and a compensating circuit for providing a compensating capacitive current to said regulating circuit, said compensating circuit comprising a capacitor and a multiplying circuit configured to accept an input capacitive current provided from said capacitor a nd multiply said input capacitive current by a predetermined multiplication factor to provide said compensating capacitive current, wherein said predetermined multiplication factor is based on a resistor ratio.

7. The LDO of claim 6, wherein said multiplying circuit comprises:

a first transistor having a first terminal and a control terminal;

a second transistor having a first terminal, a second terminal, and a control terminal, wherein said control terminal of said first transistor is coupled to said control terminal of said second transistor;

a first resistor coupled to said first terminal of said first transistor; and a second resistor coupled to said first terminal of said second transistor, wherein said resistor ratio is equal to a ratio between said first resistor and said second resistor, and wherein said compensating capacitive current is provided at said second terminal of said second transistor.

8. The LDO of claim 7, wherein said predetermined multiplication factor is equal to a first resistive value of said first resistor divided by a second resistive value of said second resistor.

9. The LDO of claim 7, wherein said first transistor and said second transistor are bipolar junction transistors, and said first terminal of said second transistor is an emitter terminal, said second terminal of said second transistor is a collector terminal, and said control electrode of said second transistor is a base terminal.

10. The LDO of claim 7, wherein said first transistor and said second transistor are MOSFET transistors.

11. The LDO of claim 6, wherein said compensation circuit further comprises a third resistor connected in parallel with said multiplying circuit.

12. The LDO of claim 11, wherein a first dominant pole is decremented by a factor based on said predetermined multiplication factor.

13. The LDO of claim 11, wherein a second non-dominant pole is incremented by a factor based on a value of said third resistor and said predetermined multiplication factor.

14. A low dropout voltage regulator (LDO) comprising:

a regulating circuit having an input terminal, an output terminal, and a control terminal, said regulating circuit configured to receive an input signal at said input terminal and provide an output signal at said output terminal; and a control circuit coupled to said control terminal of said regulating circuit, and configured to control and compensate said regulating circuit, said control circuit comprising a multiplying circuit configured to accept an input capacitive current from a capacitor and multiply said input capacitive current by a multiplication factor, wherein said multiplication factor is based on a resistor ratio.

15. The LDO of claim 14, wherein said multiplying circuit comprises:

a first transistor having a first terminal and a control terminal;

a second transistor having a first terminal, a second terminal, and a control terminal, wherein said control terminal of said first transistor is coupled to said control terminal of said second transistor;

a first resistor coupled to said first terminal of said first transistor; and a second resistor coupled to said first terminal of said second transistor, wherein said resistor ratio is equal to a ratio between said first resistor and said second resistor, and wherein said compensating capacitive current is provided at said second terminal of said second transistor.

16. The LDO of claim 15, wherein said predetermined multiplication factor is equal to a first resistive value of said first resistor divided by a second resistive value of said second resistor.

17. The LDO of claim 15, wherein said first transistor and said second transistor are bipolar junction transistors, and said first terminal of said second transistor is an emitter terminal, said second terminal of said second transistor is a collector terminal, and said control electrode of said second transistor is a base terminal.

18. The LDO of claim 15, wherein said first transistor and said second transistor are MOSFET transistors.

19. An electronic device comprising:

a power source configured to provide an unregulated power signal; and at least one LDO coupled to said power source for providing a regulated voltage signal to an associated load of said device, wherein said at least one LDO comprises:

a regulating circuit having an input terminal, an output terminal, and a control terminal, said regulating circuit configured to receive said unregulated power signal from said power source at said input terminal and provide said regulated voltage signal at said output terminal; and a control circuit coupled to said control terminal of said regulating circuit, and configured to control and compensate said regulating circuit, said control circuit comprising a multiplying circuit configured to accept an input capacitive current from a capacitor and multiply said input capacitive current by a multiplication factor, wherein said multiplication factor is based on a resistor ratio.

20. The device of claim 19, wherein said multiplying circuit comprises:

a first transistor having a first terminal and a control terminal;

a second transistor having a first terminal, a second terminal, and a control terminal, wherein said control terminal of said first transistor is coupled to said control terminal of said second transistor;

a first resistor coupled to said first terminal of said first transistor; and a second resistor coupled to said first terminal of said second transistor, wherein said resistor ratio is equal to a ratio between said first resistor and said second resistor, and wherein said compensating capacitive current is provided at said second terminal of said second transistor.

21. The device of claim 20, wherein said predetermined multiplication factor is equal to a first resistive value of said first resistor divided by a second resistive value of said second resistor.

22. The device of claim 20, wherein said first transistor and said second transistor are bipolar junction transistors, and said first terminal of said second transistor is an emitter terminal, said second terminal of said second transistor is a collector terminal, and said control electrode of said second transistor is a base terminal.

23. The device of claim 20, wherein said first transistor and said second transistor are MOSFET transistors.

24. A method of compensating a regulating circuit wherein said regulating circuit has an output terminal and a control terminal, said method comprising the steps of:

receiving an input capacitive current through a capacitor coupled to said control terminal of said regulating circuit; and multiplying said input capacitive current by a multiplication factor to provide said compensating capacitive current to said control terminal of said regulating circuit, wherein said multiplication factor is based on a resistor ratio.

25. A compensating circuit for providing a compensating voltage gain to a regulating circuit, said compensation circuit comprising:

a voltage gain stage circuit configured to accept a first voltage signal representative of an output voltage level of said regulating circuit and multiply said first voltage signal by a predetermined multiplication factor to provide a second voltage signal; and a capacitor configured to accept said second voltage signal and provide said compensating voltage gain to said regulating circuit.

26. The compensating circuit of claim 25, wherein said voltage gain stage circuit comprises a differential pair circuit configured to accept said first voltage signal and a follower circuit configured to provide said second voltage signal.

27. The compensating circuit of claim 26, wherein said compensating circuit further comprises a current mirror configured to accept an input current from said differential pair and provide an output current to said follower circuit.

28. The compensating circuit of claim 25, wherein said differential pair comprises a bipolar transistor differential pair.

29. The compensating circuit of claim 25, wherein said follower circuit comprises an emitter follower circuit.

30. The compensating circuit of claim 29, wherein an emitter terminal of said emitter follower circuit is configured to provide said second voltage signal to said capacitor.

31. A low dropout voltage regulator (LDO) comprising:

a regulating circuit having an input terminal, an output terminal, and a control terminal, said regulating circuit configured to receive an input voltage signal at said input terminal and provide an output voltage signal at said output terminal;

a control circuit coupled to said control terminal of said regulating circuit, and configured to control said regulating circuit; and a compensation circuit coupled to said control terminal of said regulating circuit and configured to provide a compensating voltage gain to said regulating circuit, said compensation circuit comprising:

a voltage gain stage circuit configured to accept a first voltage signal representative of said output voltage signal of said regulating circuit and multiply said first voltage signal by a predetermined multiplication factor to provide a second voltage signal; and a capacitor configured to accept said second voltage signal and provide said compensating voltage gain to said regulating circuit.

32. The LDO of claim 31, wherein said voltage gain stage circuit comprises a differential pair circuit configured to accept said first voltage signal and a follower circuit configured to provide said second voltage signal.

33. The LDO of claim 32, wherein said compensating circuit further comprises a current mirror configured to accept an input current from said differential pair and provide an output current to said follower circuit.

34. The LDO of claim 31, wherein said differential pair comprises a bipolar transistor differential pair.

35. The LDO of claim 31, wherein said follower circuit comprises an emitter follower circuit.

36. The LDO of claim 35, wherein an emitter terminal of said emitter follower circuit is configured to provide said second voltage signal to said capacitor.

37. An electronic device comprising:

a power source configured to provide an unregulated power signal; and at least one LDO coupled to said power source for providing a regulated voltage signal to an associated load of said device, wherein said at least one LDO comprises:

a regulating circuit having an input terminal, an output terminal, and a control terminal, said regulating circuit configured to receive an input voltage signal at said input terminal and provide an output voltage signal at said output terminal;

a control circuit coupled to said control terminal of said regulating circuit, and configured to control said regulating circuit; and a compensation circuit coupled to said control terminal of said regulating circuit and configured to provide a compensating voltage gain to said regulating circuit, said compensation circuit comprising a voltage gain stage circuit configured to accept a first voltage signal representative of said output voltage signal of said regulating circuit and multiply said first voltage signal by a predetermined multiplication factor to provide a second voltage signal, and a capacitor configured to accept said second voltage signal and provide said compensating voltage gain to said regulating circuit.

38. The device of claim 37, wherein said voltage gain stage circuit comprises a differential pair circuit configured to accept said first voltage signal and a follower circuit configured to provide said second voltage signal.

39. The device of claim 38, wherein said compensating circuit further comprises a current mirror configured to accept an input current from said differential pair and provide an output current to said follower circuit.

40. The device of claim 37, wherein said differential pair comprises a bipolar transistor differential pair.

41. The device of claim 37, wherein said follower circuit comprises an emitter follower circuit.

42. The device of claim 41, wherein an emitter terminal of said emitter follower circuit is configured to provide said second voltage signal to said capacitor.

43. A method of compensating a regulating circuit wherein said regulating circuit has an output terminal and a control terminal, said method comprising the steps of:

receiving a first voltage signal representative of an output voltage at said output terminal of said regulating circuit;

multiplying said first voltage signal by a predetermined multiplication factor to provide a second voltage signal; and providing said second voltage signal to a capacitor, said capacitor in turn provides a compensating voltage gain to said control terminal of said regulating circuit.

* * * * *